US005933913A

United States Patent [19]

Wright et al.

[11] Patent Number: 5,933,913

[45] Date of Patent: Aug. 10, 1999

[54] CORDLESS WET MOP AND VACUUM ASSEMBLY

[75] Inventors: Michael F. Wright, Stow; Laurie M. Shumaker, Tallmadge; Craig M. Saunders, Rocky River; Joseph Lazzara, Beachwood; Mark Cipolla, Chardon; Glenn E. Specht, Massillon; Richard C. Farone, Wickliffe; Jeffrey M. Kalman, Cleveland Hts.; Terry L. Zahuranec, N. Olmsted, all of Ohio

[73] Assignee: Royal Appliance Mfg. Co., Cleveland, Ohio

[21] Appl. No.: 09/093,205

[22] Filed: Jun. 8, 1998

Related U.S. Application Data

[62] Division of application No. 08/775,284, Dec. 31, 1996

[60] Provisional application No. 60/019,251, Jun. 7, 1996.

[51] Int. Cl.[6] ..... A47L 7/00

[52] U.S. Cl. ..... 15/320; 15/50.1

[58] Field of Search ..... 15/320, 321, 50.1

[56] References Cited

U.S. PATENT DOCUMENTS

| | | | |
|---|---|---|---|
| 1,122,079 | 12/1914 | Cunneen . | |
| 1,688,580 | 10/1928 | Gernandt . | |
| 2,100,806 | 11/1937 | Kern . | |
| 2,187,671 | 1/1940 | Suddarth . | |
| 2,201,079 | 5/1940 | Camden . | |
| 2,348,861 | 5/1944 | Smellie . | |
| 2,635,278 | 4/1953 | Belknap | 15/320 X |
| 2,822,061 | 2/1958 | Pettit et al. . | |
| 2,954,576 | 10/1960 | Helm . | |
| 2,986,764 | 6/1961 | Krammes . | |
| 2,989,769 | 6/1961 | Houser . | |
| 3,018,504 | 1/1962 | Hart . | |
| 3,020,576 | 2/1962 | Gerber . | |
| 3,029,461 | 4/1962 | Osborn . | |
| 3,040,362 | 6/1962 | Krammes . | |
| 3,040,363 | 6/1962 | Krammes et al. . | |
| 3,060,484 | 10/1962 | Krammes . | |
| 3,069,716 | 12/1962 | Smith . | |
| 3,101,505 | 8/1963 | Belicka et al. . | |
| 3,126,573 | 3/1964 | Vosbikian et al. . | |
| 3,210,794 | 10/1965 | Vosbikian . | |
| 3,224,023 | 12/1965 | Brodie | 15/320 X |
| 3,491,398 | 1/1970 | Segesman . | |
| 3,540,072 | 11/1970 | Wolter et al. . | |
| 3,639,939 | 2/1972 | Crener et al. | 15/320 |
| 3,727,259 | 4/1973 | Wilson . | |

(List continued on next page.)

FOREIGN PATENT DOCUMENTS

| | | |
|---|---|---|
| 202357 | 7/1956 | Australia . |
| 31136 | 11/1926 | France . |
| 1526754 | 5/1968 | France . |
| 2420326 | 10/1979 | France . |
| 2653002 | 4/1991 | France . |
| 2424218 A1 | 11/1975 | Germany . |
| 1567815 A1 | 5/1990 | U.S.S.R. . |
| 2 146 890 | 5/1985 | United Kingdom . |
| 2 178 303 | 2/1987 | United Kingdom . |
| 724871 | 2/1995 | United Kingdom . |

*Primary Examiner*—Chris K. Moore

*Attorney, Agent, or Firm*—Fay, Sharpe, Beall, Fagan, Minnich & McKee

[57] ABSTRACT

The present invention relates to a suction cleaning device which provides liquid dispensing, scrubbing, squeegeeing, and suction drying in a single, compact, self contained device. The suction cleaning device includes a cleaning device housing, a handle connected to the housing, an absorbent cleaning member mounted on the housing and movable between an extended and a retracted position, and a pair of squeegee blades. The device includes a suction system which draws the water from the floor surface which has been cleaned into a tank mounted on the housing which collects the liquid from the floor surface. A clean water bottle is provided on the housing for delivering cleaning liquid to the floor and a rechargeable battery power source provides power to the suction motor. The cleaning device is compact and lightweight and leaves the floor in a substantially dry state.

8 Claims, 9 Drawing Sheets

U.S. PATENT DOCUMENTS

| | | | |
|---|---|---|---|
| 3,939,527 | 2/1976 | Jones . | |
| 3,960,454 | 6/1976 | Schroeder . | |
| 4,112,538 | 9/1978 | Bates . | |
| 4,119,386 | 10/1978 | Cushing . | |
| 4,123,818 | 11/1978 | Hurwitz . | |
| 4,363,152 | 12/1982 | Karpanty . | |
| 4,393,537 | 7/1983 | Reprogle et al. . | |
| 4,446,595 | 5/1984 | Nakada et al. . | |
| 4,462,137 | 7/1984 | Berfield et al. . | |
| 4,498,214 | 2/1985 | Oxel . | |
| 4,516,287 | 5/1985 | Johnson et al. . | |
| 4,566,149 | 1/1986 | Fitzwater . | |
| 4,686,735 | 8/1987 | Soeffker et al. . | |
| 4,776,058 | 10/1988 | Garner et al. | 15/320 |
| 4,782,551 | 11/1988 | ballwebber . | |
| 4,831,685 | 5/1989 | Bosyj et al. . | |
| 4,845,802 | 7/1989 | Miller et al. . | |
| 4,863,299 | 9/1989 | Osberghaus et al. . | |
| 4,905,343 | 3/1990 | Jailor . | |
| 4,939,808 | 7/1990 | Roden et al. . | |
| 4,953,254 | 9/1990 | Kohl et al. . | |
| 5,028,004 | 7/1991 | Hammelmann . | |
| 5,067,199 | 11/1991 | Alazet . | |
| 5,097,561 | 3/1992 | Torres . | |
| 5,103,526 | 4/1992 | Berfield . | |
| 5,289,610 | 3/1994 | Monson . | |
| 5,299,608 | 4/1994 | Bosyj | 15/320 X |
| 5,347,676 | 9/1994 | Saitoh . | |
| 5,386,612 | 2/1995 | Sham . | |
| 5,483,726 | 1/1996 | Blase et al. . | |
| 5,493,752 | 2/1996 | Crouset et al. . | |
| 5,555,599 | 9/1996 | Markley . | |
| 5,590,439 | 1/1997 | Alazet . | |
| 5,603,139 | 2/1997 | Alazet . | |
| 5,655,248 | 8/1997 | Kieson et al. . | |
| 5,761,762 | 6/1998 | Kubo . | |
| 5,819,366 | 10/1998 | Edlin . | |

CORDLESS WET MOP AND VACUUM ASSEMBLY

This application is a divisional application under 37 C.F.R 1.60 of pending prior application Ser. No. 08/775,284, filed Dec. 31, 1996 of Michael F. Wright et al., claiming priority from U.S. Provisional Application Ser. No. 60/019,251, filed Jun. 7, 1996.

BACKGROUND OF THE INVENTION

The present invention relates to an improved wet mop. More specifically, the present invention is directed to a cordless wet mop including a scrubbing assembly and a vacuum assembly for collecting dirty water from the floor to achieve a clean and substantially dry floor surface.

Mops for cleaning floor surfaces generally include an absorbent mop or sponge head and some type of wringing mechanism for wringing dirty water out of the mop or sponge head. In particular, the mop is used in conjunction with a bucket of cleaning liquid, usually consisting of water with a cleaning additive. The mop absorbs the cleaning liquid which is used to scrub the floor. Once the mop has been contaminated by scrubbing the floor, it is inserted back into the bucket to rinse the mop and to absorb additional cleaning liquid. The continuous introduction of the dirty mop into the clean liquid in the bucket quickly contaminates the clean liquid in the bucket and reduces the cleaning ability during a remainder of the mopping operation. Thus, it would be desirable to prevent contamination of the cleaning liquid during a floor cleaning operation. In addition, it would be desirable to eliminate the approximately 15 minutes of floor drying time necessary with conventional mop and bucket cleaning.

Suction squeegees have been proposed which remove cleaning liquid from a floor surface which has previously been cleaned. One such suction squeegee device is disclosed in U.S. Pat. No. 5,067,199. However, this suction squeegee device does not eliminate the problem of contamination of the clean water bucket because a conventional mop and bucket must be used to clean the floor prior to use of the suction squeegee device. In addition, this suction squeegee has the disadvantage of requiring three or four separate devices to perform the cleaning operation including the suction squeegee, a mop, a mechanism to wring dirty water out of the mop, and a bucket.

Another suction cleaning apparatus has been described which provides a combined scrubbing and water pick-up apparatus for cleaning and drying a floor surface. This device includes a combined clean water and dirty water tank with a flexible membrane separating the clean and dirty water in the tank. Clean water is dispensed from the tank and a cleaning nozzle including bristles or brushes used for scrubbing. After scrubbing, a suction system is activated to remove the dirty water from the floor and the dirty water is collected in the tank.

Examples of combination scrubbing and water pick-up devices are disclosed in U.S. Pat. Nos. 2,986,764; 3,020,576; 3,040,362; 3,040,363; and 3,060,484. The devices described in these patents have several drawbacks including the cumbersome size and weight of the device, the need for a power supply cord which gets in the users way, and the safety concerns associated with the use of household voltage in combination with a water filled device.

SUMMARY OF THE INVENTION

The device according to the present invention addresses the disadvantages of the prior art by providing an entirely self contained cordless wet mop which combines scrubbing and drying in one device and leaves the floor in a substantially dry state.

According to an additional aspect of the present invention, a suction cleaning device for cleaning surfaces includes a cleaning device housing, a handle connected to the housing, an absorbent cleaning member mounted on the housing and movable between an extended position in which the cleaning member extends from the housing and is used to clean a surface and a retracted position in which the cleaning member is substantially retracted into the housing, a suction motor within the housing for removing a contaminated liquid from the surface, a tank mounted on the housing for collecting the contaminated liquid which has been removed from the surface by operation of the suction motor, and a battery power source providing power to the suction motor.

According to a further aspect of the present invention, a suction cleaning device for cleaning surfaces includes a cleaning device housing, a retractable sponge mounted on the housing and movable between an extended position and a retracted position, a retracting mechanism for moving the sponge between the extended and retracted positions, a suction system for removing and collecting contaminated liquid from a surface to be cleaned, and a switch for activating the suction system in response to the retraction mechanism, wherein the suction system is turned on when the sponge is in the retracted position, and the suction system is turned off when the sponge is in the extended position.

According to an additional aspect of the invention, a self contained mopping and drying system for floors includes a housing, a handle connected to the housing, an absorbent cleaning member mounted on the housing, a pair of squeegees mounted on the housing for collecting contaminated liquid on a floor surface, a suction system within the housing for removing the contaminated liquid from the floor surface which has been collected by the pair of squeegees, wherein the suction system leaves the floor in a substantially dry state, a tank mounted on the housing for collecting the contaminated liquid which has been removed from the surface by operation of the suction motor, and a battery power source received in the housing and providing power to the suction system.

According to a further aspect of the invention, a cleaning device includes a cleaning device housing, a handle connected to the housing, a sponge mounted on the housing and movable between an extended position in which the sponge extends from the housing and is used to clean a surface and a retracted position in which the sponge is substantially retracted into the housing, the sponge having a central plane bisecting the sponge, a pair of squeegees mounted on the housing in a parallel spaced arrangement, the pair of squeegees positioned in first and second planes, and wherein the central plane of the sponge diverges from the first and second planes of the squeegees in a direction away from the housing.

One advantage of the cleaning device is that a single self-contained device performs liquid dispensing, scrubbing, and drying.

Another advantage of the cleaning device is that the contamination of a cleaning liquid is prevented by providing separate clean water and dirty water tanks.

An additional advantage of the cleaning device is the compact size and light weight of the device.

Still other advantages and benefits of the invention will become apparent to those skilled in the art upon a reading and understanding of the following detailed description.

BRIEF DESCRIPTION OF THE DRAWINGS

The invention may take physical form in certain parts and arrangements of parts, preferred embodiments and methods of which will be described in detail in this specification and illustrated in the accompanying drawings which form a part hereof, and wherein.

DETAILED DESCRIPTION OF THE PREFERRED EMBODIMENTS

Figure 1:
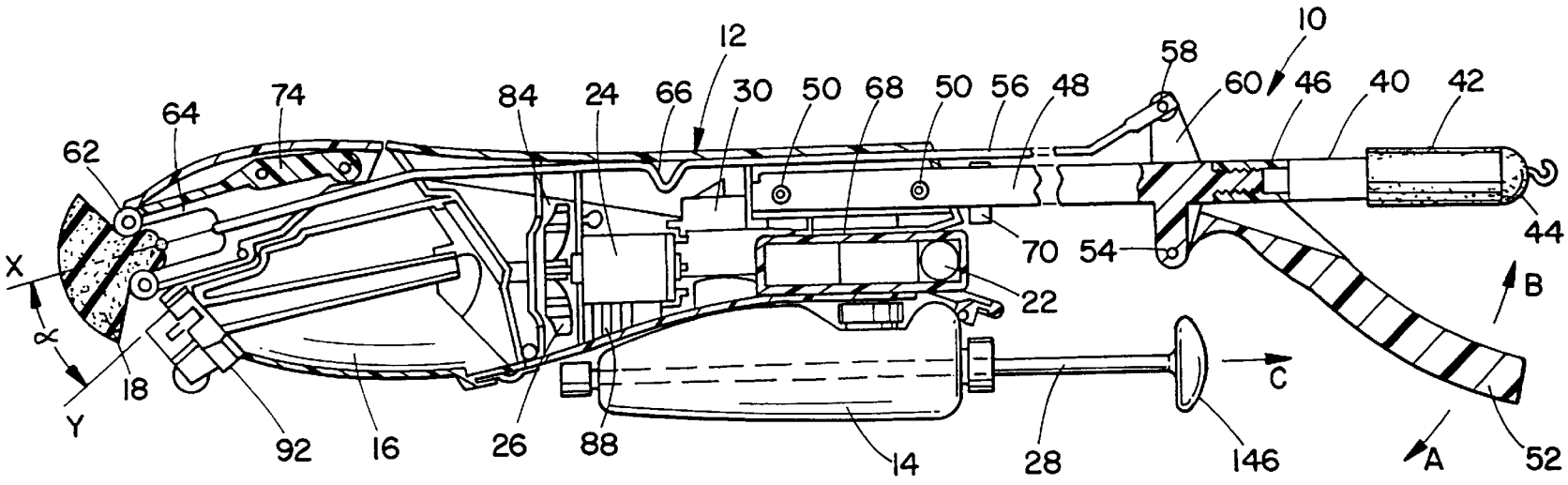
FIG. 1 is a longitudinal cross section taken through the center of a first embodiment of the present invention with the sponge shown in an extended position, and the battery pack latch shown in an unlocked position.
Figure 2:
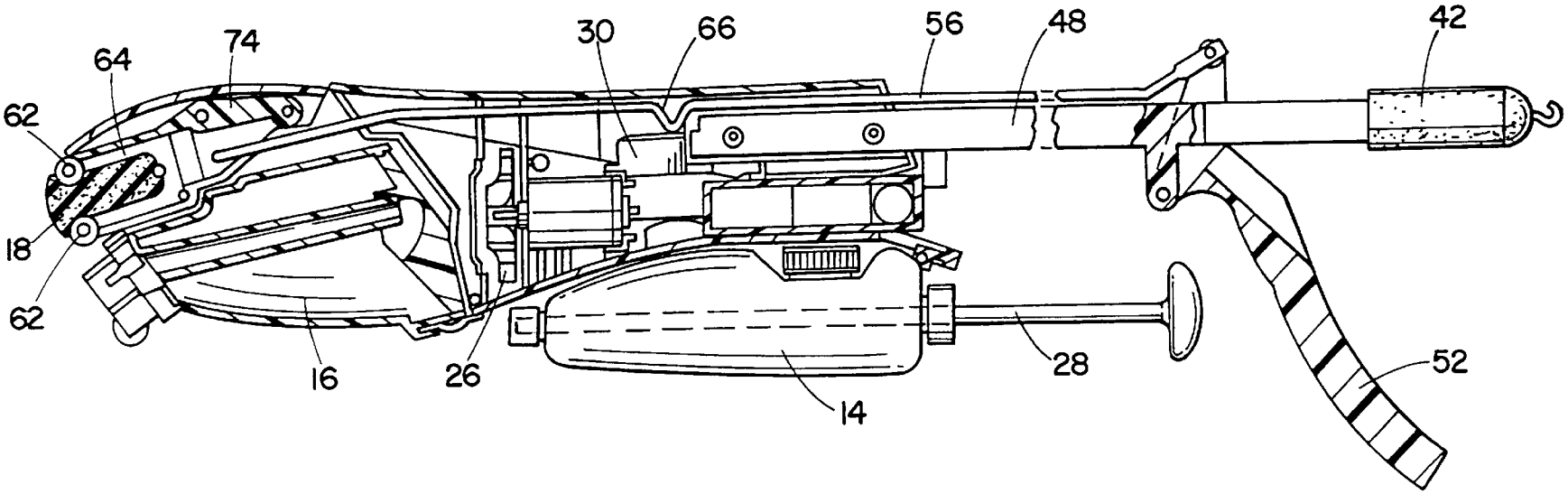
FIG. 2 is a longitudinal cross section as illustrated in FIG. 1 with the sponge shown in a retracted position and the battery pack latch shown in a locked position.
Figure 3:
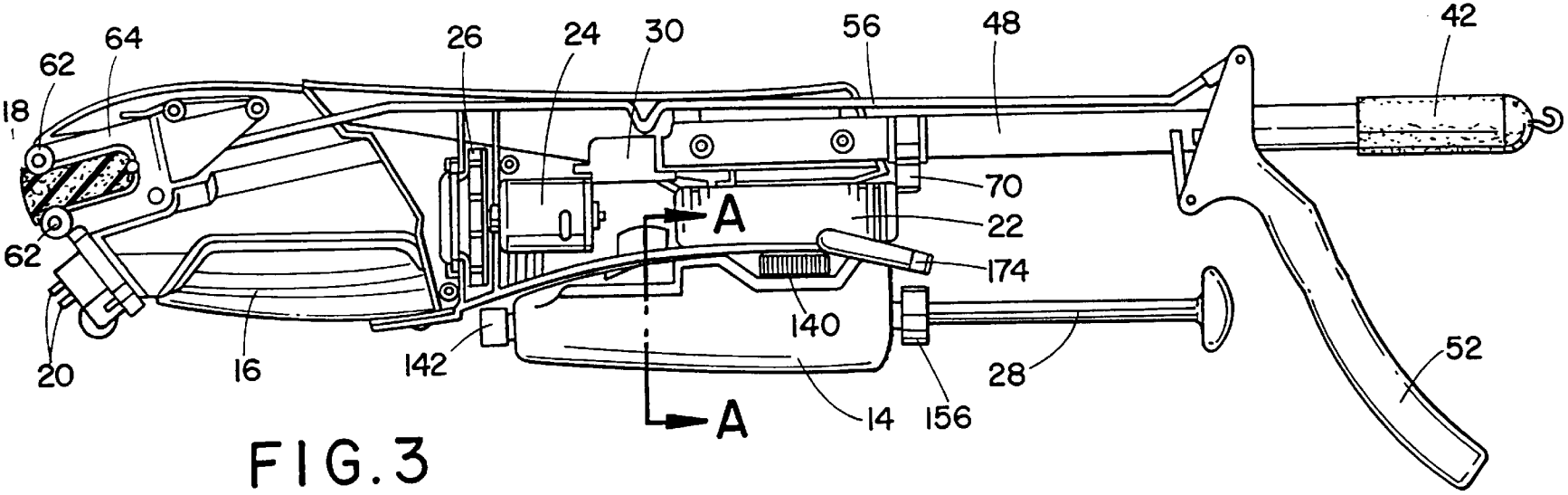
FIG. 3 is a side view of the embodiment of FIG. 1 with a side of the housing removed and the sponge in the retracted position.
Figure 4:
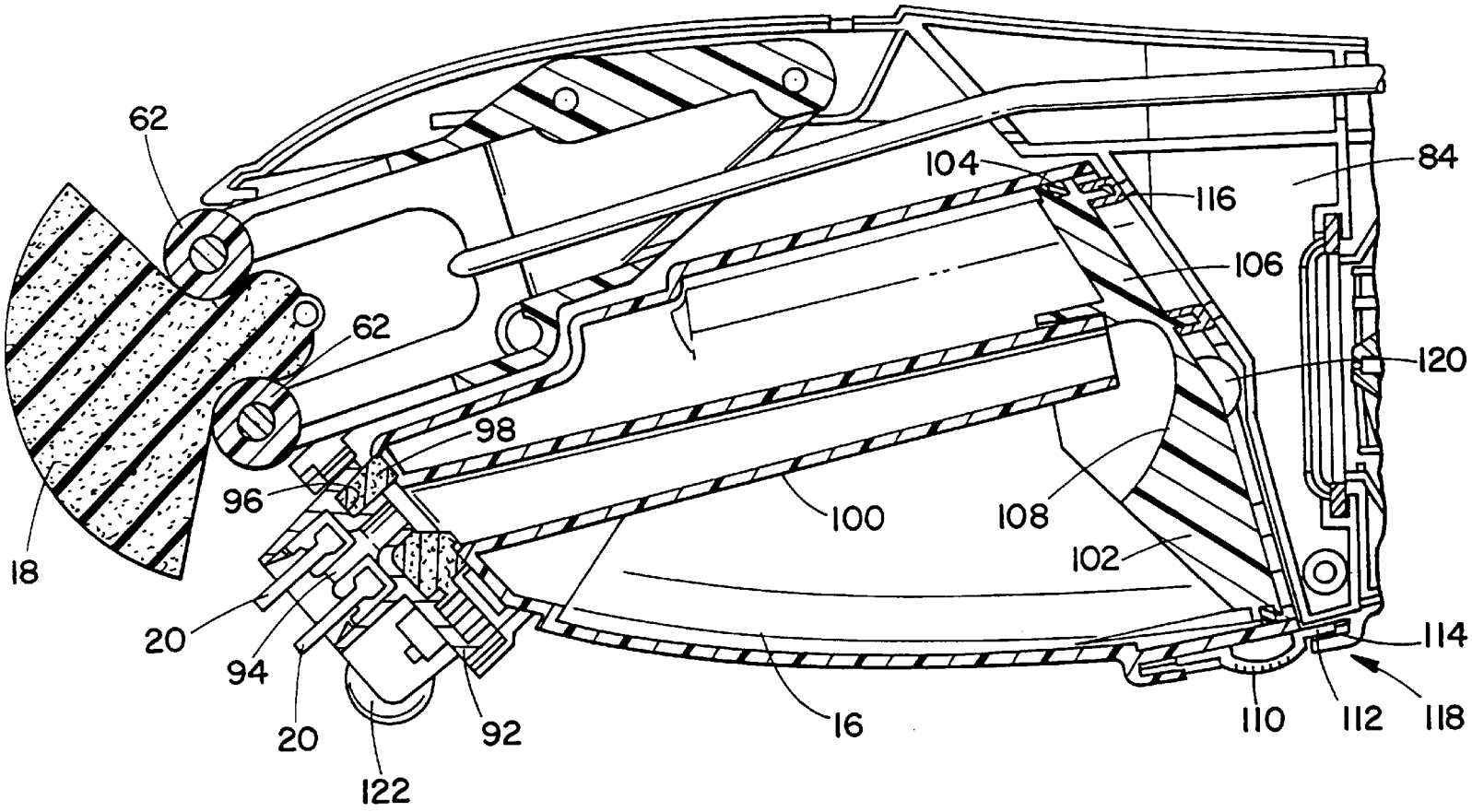
FIG. 4 is an enlarged cross section of the forward end of the embodiment of FIG. 1.

Referring now to the drawings wherein the showings are for the purposes of illustrating the preferred embodiments of the invention only and not for purposes of limiting same, a cordless wet mop and vacuum device according to a first embodiment of the present invention is illustrated in FIGS. 1–5. The device generally includes a handle assembly 10 connected to a housing 12, a removable clean water bottle 14, and a removable dirty water tank 16. A cleaning assembly is mounted in the housing 12 and includes a retractable sponge 18, a pair of squeegees 20, a battery pack 22, a suction motor 24, a suction fan 26, and a switch 30 for turning the suction motor on and off. The clean water bottle 14 includes a plunger 28 for dispensing clean water combined with a cleaning solution onto the floor. The sponge 18 is extended from the housing 12 when it is used to scrub the floor and is then retracted into the housing during the suction operation. The retraction of the sponge 18 activates the suction motor 24 and causes the suction system to begin to draw the water from the floor into the dirty water tank 16. The squeegees 20, shown in FIGS. 3 and 4, are drawn over the floor while the suction is activated to collect the dirty water and leave the floor in a substantially dry state.

The handle assembly 10 includes an upper handle 40 with a foam hand grip 42 and a cap 44. The cap 44 is preferably provided with a swivel which may be used to hang the device on the wall. The upper handle 40 includes a threaded insert 46 which allows the upper handle to be threaded onto a lower handle 48 which is a one piece handle fixed in the housing 12 by at least two bolts 50. The one piece handle 48 is preferably molded of plastic and includes the threaded section for mating with the treaded insert 46, a support for a wringer handle 52, and means to mount the lower handle 48 on the housing 12.

The wringer handle 52 is pivotally mounted on the lower handle 48 at a first pivot 54 and is pivotally attached to a rod 56 at a second pivot 58. The wringer handle 52 is constructed with two legs 60 one of which extends around each side of the lower handle 48. A flat end of the rod 56 is inserted between the two legs 60 and is pivotally attached to the legs by a pin extending through the rod and the legs. The rod 56 extends alongside the lower handle 48 and through the housing 12. An opposite end of the rod 56 passes through a metal bracket 64 and attaches to the sponge 18.

Operation of the wringer handle 52 extends and retracts the sponge 18 and simultaneously turns on and off the suction motor 24 via the switch 30. The wringer handle 52 moves the sponge 18 between three positions. In the extended position illustrated in FIG. 1, the sponge 18 extends in fan like shape beyond a pair of sponge rollers 62 which are mounted on a wringer bracket 74. In the extended position, the metal bracket 64 abuts the rollers 62 and holds the sponge in the desired cleaning position. To retract the sponge 18, the wringer handle 52 is moved away from the upper handle 40 in the direction of the arrow A. As the wringer handle is moved, the rod 56 causes the sponge to be pulled upward. As the sponge 18 is retracted, the water which has been absorbed in the sponge is wrung out onto the floor by squeezing the sponge between the rollers 62.

The retracted position of the sponge 18 is illustrated in FIG. 2. In this position, the sponge 18 is received in the metal bracket 64 and a forward end of the sponge extends only a small distance past the ends of rollers 62. This distance is preferably between 0.1 inches and 0.5 inches. The sponge 18 is held in the retracted position by the expansion of a portion of the sponge behind the rollers 62. In addition, detents (not shown) may be provided in the wringer handle 52 to maintain the sponge in the retracted position.

The wringer handle 52 also is used to eject the sponge 18 for replacement or cleaning. The ejection of the sponge 18 is performed by moving the wringer handle 52 toward the upper handle 40 in the direction of the arrow B. This forces the sponge 18 and the metal bracket 64 through the rollers 62 which flex apart in the wringer bracket 74.

The wringer handle 52 also turns on and off the suction motor 24 by operating the switch 30 with a protruding bend 66 in the rod 56. Thus, the suction motor 24 is operated only when the sponge 18 is retracted. This allows the conservation of battery power by preventing motor operation when it is not necessary, allowing the battery power of the battery pack 22 to be conserved. As seen in FIG. 2, when the sponge is retracted, the protruding bend 66 in the rod 56 passes over the switch 30 turning the suction motor 24 on.

Generally, a 6 volt battery pack 22 having 5 cells will provide between 5 and 10 minutes of operating time for a 12–14 amp permanent magnet motor. Since the suction motor 24 is operated only when suction is required, the battery pack 22 will be able to be used for a floor of at least 250 square feet without requiring recharging.

Figure 5:
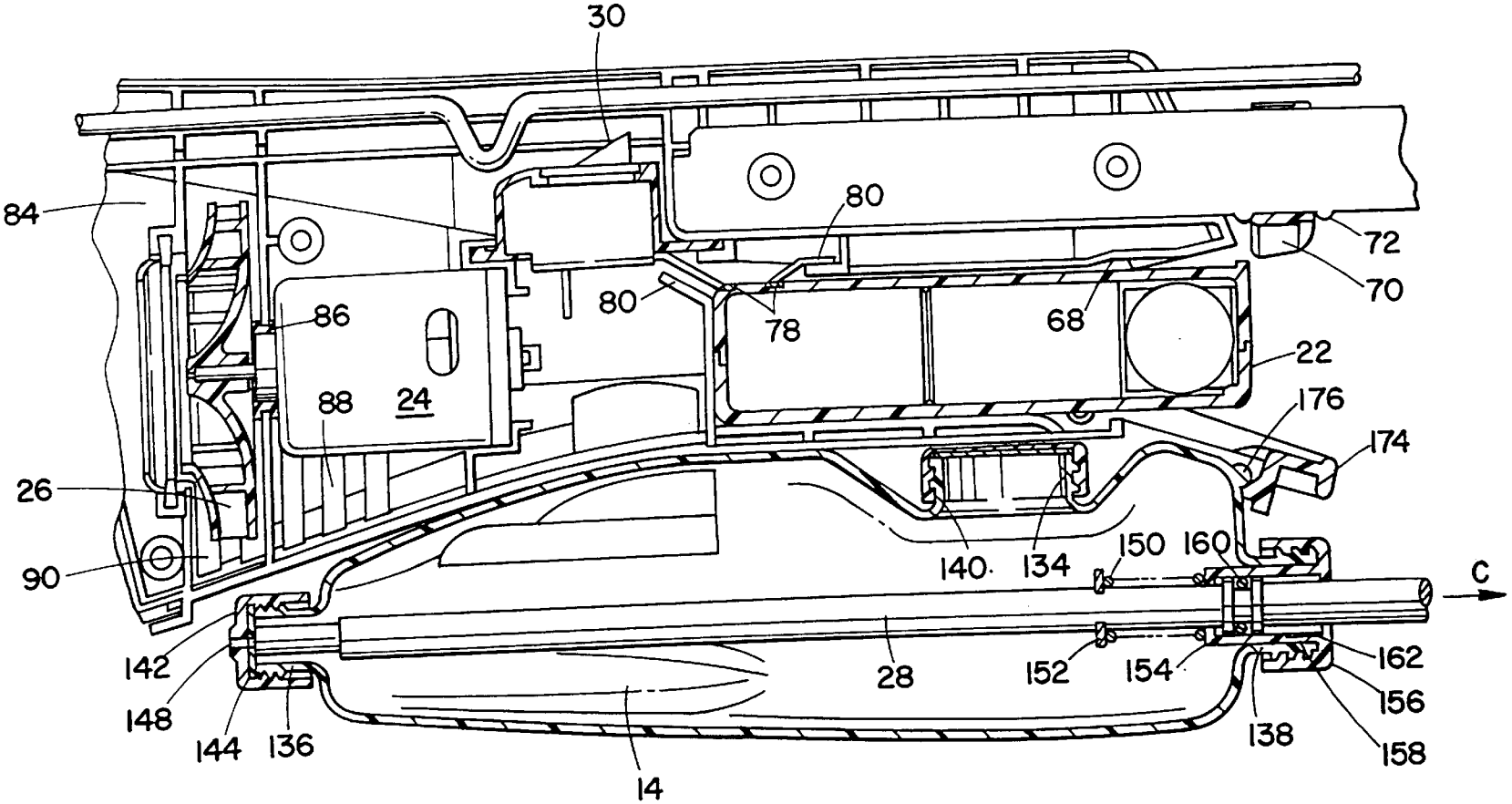
FIG. 5 is an enlarged cross section of the central section of the embodiment of FIG. 1.

The battery pack 22 is illustrated more clearly in FIG. 5 which is an enlargement of a central portion of FIG. 1. The battery pack 22 is preferably a 6 volt rechargeable battery pack capable of holding up to six cells which is received in a battery cavity 68 within the housing 12. The battery pack is held in place in the cavity by a locking member 70 which is rotatable about the lower handle 48. Two protrusions 72 on the lower handle maintain the locking member 70 at the proper axial location on the handle. The locking member 70 is illustrated in unlocked and locked positions in FIGS. 1 and 2, respectively.

As the battery pack 22 slides into the battery cavity 68, two spring loaded battery contacts 80 are moved out of the way and into a position in which the battery contacts 80 in the battery cavity contact mating battery contacts 78 on the side surface of the battery pack.

The suction motor 24 is mounted within a motor mount assembly 82 in a conventional manner, such as mounting the motor in a pair of saddles molded into the interior of the housing 12. The suction motor 24 is preferably a permanent magnet dc motor, such as a 12–14 amp, 6 volt strontium magnet motor providing an output of about 18,000 to 25,000 rpm, preferably 21,000 to 22,000 rpm. The suction motor 24 is isolated from an adjacent fan chamber 84 by a resilient grommet 86, shown in FIG. 5, which prevents any water which may enter the fan chamber from passing into the motor.

The suction motor 24 used in the present invention is self cooling and does not require a fan for cooling. However, a motor fan may be added if needed. Vents 88 are preferably provided in a side of the housing 12 for allowing air circulation to the motor. The fan chamber 84 also includes exhaust vents 90 through which the exhaust gas passes.

The lower portion of the housing is best illustrated in the enlarged view of FIG. 4 and includes the sponge, a squeegee tray 92, the dirty water tank 16, the fan chamber 84, and the suction fan 26.

The squeegee tray 92 includes two elongated squeegees 20 which snap into the squeegee tray 92 in a known manner. The squeegees are between 5 and 20 inches long, preferably between 8 and 12 inches long. The squeegee tray 92 has a suction inlet 94 which is an elongated oval-shaped opening located between the two squeegees 20 and extending along about ¼ to ½ of the total length of the squeegees at the center of the squeegees. The water is drawn up along the length of the squeegees 20 from the open ends between the squeegees into the suction inlet 94. The cross-sectional area of a passageway between the two squeegees and the floor, and the cross-sectional area of the suction inlet 94 are both dimensioned to provide a desired velocity of air which will entrain the water droplets in the air. Operating at velocities of between about 1,000 ft/min and about 3,000 ft/min or higher will maintain the water droplets entrained in the air.

A set of wheels 122 are mounted on the squeegee tray 92 to allow the entire device to be easily wheeled across the floor during scrubbing, squeegeeing, or transporting. The squeegees 20 are mounted in the squeegee tray 92 in a parallel configuration such that when the device is wheeled across the floor, both squeegees are in contact with the floor. When the sponge 18 is in an extended position, the squeegees 20 will no longer contact the floor because the sponge extends beyond the squeegees. A central plane X which bisects the sponge 18 is positioned at an angle $\alpha$ with respect to the planes Y of the squeegees. This angle $\alpha$ is approximately between 10 and 30 degrees, preferably about 25 degrees.

The top surface of the squeegee tray 92 includes an oval-shaped groove 96 surrounding the suction inlet 94. A resilient sealing member 98 is placed in the groove 96 to provide a seal between the suction inlet 94 and a central tube 100 of the dirty water tank 16. The resilient sealing member 98 is preferably a compressible sponge rubber material which biases the tank 16 upward so that it is in a proper position once it has been inserted into the housing 12.

The squeegees 20 are each formed with a smooth edge on one side and a serrated edge on an opposite side. The squeegees are positioned within the squeegee tray 92 with the smooth sides of the two squeegees facing each other. Thus, as the device is moved across the floor, both of the squeegees will contact the floor and flex. The water will first pass under the first squeegee due to the fact that the serrated edge of the squeegee is in contact with the floor. This water will then be trapped by the second squeegee having the smooth edge in contact with the floor. In this way the device may be used alternately in both a forward and a reverse direction as the user works across the floor surface. The water is collected from between the squeegees by a flow of air from the open ends between the squeegees to the central suction inlet 94.

From the central suction inlet 94, the water passes into the dirty water tank 16 including the central tube 100 which is molded into the tank. The central tube 100 extends far enough up into the tank 16 to avoid the need for a closing member to close the central tube against leaks when the tank is removed for emptying. A cover 102 is placed inside the top of the tank 16 and is sealed about the edges to the tank by an 0-ring 104. The cover 102 includes an opening 106 through which air passes from the tank 16 to the fan chamber 84. The cover 102 also includes a baffle 108 for deflecting the water which is drawn through the central tube 100 into the tank. A face seal 116 is provided around the opening 106 in the cover 102 to seal the passage between the dirty water tank 16 and the fan chamber 84.

The central tube 100 and the baffle 108 are positioned within the dirty water tank 16 such that a majority of the tank capacity is available in an inclined operating position. In addition, if the device is laid down with a back surface 118 of the device on the floor when the dirty water tank is 16 partially filled, the dirty water will not come out through either the central tube 100 or the opening 106 to the fan chamber 84.

The dirty water tank 16 and cover 102 assembly are removable from the housing 12 for emptying and cleaning. The tank 16 is inserted by placing the bottom of the tank against the sealing member 98 and rocking the tank forward into the housing. Once inserted, the tank 16 is held in place by a latch 110 which is slidably mounted on the exterior of the tank and has a protrusion 112 which is received in a corresponding recess 114 in the housing 12. The cover 102 of the dirty water tank 16 may also include one or more detents 120 which retain the tank in the housing while the latch 110 is being operated.

The suction system operates by drawing air from the open ends between the two squeegees 20 through the suction inlet 94 and the central tube 100 of the dirty water tank 16 at a velocity which entrains the water droplets in the air. The water hits the baffle 108 within the tank 16 and is deflected down into the tank. The velocity of the air slows as it enters the tank 16 from the central tube 100 and the entrained water droplets fall out into the tank. The air then passes around both sides of the central tube 100, out of the tank through the opening 106, into the fan chamber 84, through the suction fan 26, and out of the housing via the vents 90. In order to maintain the velocity drop in the tank 16 which causes the water to fall out of the air in the tank, the cross-sectional area of the air passage through the tank between the baffle 108 and the opening 106 must be larger than the cross-sectional area of the central tube 100. As long as the velocity of the air in the tank is decreased to less than about 1000 ft/min, the water will remain in the tank.

The dirty water tank 16 may also include a control device which turns off the suction when the water in the tank 16 has reached a certain level. This device may include a float device which blocks off the tank opening 106 when the tank 16 is full. Alternately, the motor which is used may provide an automatic shut off. For example, a motor having 9 inches of sealed suction will provide an automatic shut off when the tank is filled to 9 inches.

A cleaning solution is dispensed onto the floor surface prior to scrubbing by the clean water bottle 14 which is removably mounted on a front surface 124 of the housing. The cleaning solution or cleaning liquid which is used in the clean water bottle according to the present invention may be any known cleaning solution or combination of solutions, such as water with a detergent additive.

The bottle 14 is preferably a blow molded bottle having three openings and a plunger 28 which is activated to allow the cleaning solution to be released onto the floor. A first opening 134 is provided on a side surface of the bottle and has a threaded cap 140 which is removed for filling the bottle. Because the first opening 134 is located on a side of the bottle, the bottle can easily be filled in a sink. The cap 140 may be used as a measuring device to measure the desired amount of a cleaning additive which is mixed with water in the bottle.

The second opening 136 is provided with a threaded dispensing cap 142 having a dispensing opening 148 and a plunger seat or seal 144 surrounding the dispensing opening against which an end of the plunger is sealed. The third opening 138 receives the plunger 28 and provides a vent. The three-opening bottle 14 allows the bottle to be filled without removing the plunger 28 from the bottle.

The plunger 28 has a handle 146, illustrated in FIG. 1, at a first end 14 and a second end extends through the third opening 138 in the bottle 14 to engage the plunger seat 144 and close the dispensing opening 148. A spring 150, best illustrated in FIG. 5, acts between an annular ring 152 on the plunger 132 and a bottom surface 154 of a plunger receiving cap 156 to bias the plunger in a closed position.

The plunger cap 156 includes a cylindrical portion 158 which extends into the neck of the opening 138 in the bottle 14 and provides a venting mechanism for venting air from the bottle when the plunger handle 146 is pulled in the direction of the arrow C. The interior of the cylindrical portion 158 of the plunger cap has a groove 162 which provides the venting mechanism. A first O-ring 160 located in an annular seat 166 on the plunger provides a seal between the plunger 28 and the plunger cap 156 in the closed position. However, when the plunger handle 146 is moved upward in the direction of the arrow C opening the dispensing opening 148, the first O-ring 160 slides up above the groove 162 and allows air to pass through the cap into the bottle. A second O-ring 164 provides a seal between the plunger cap 156 and the bottle 14.

Figure 3A:
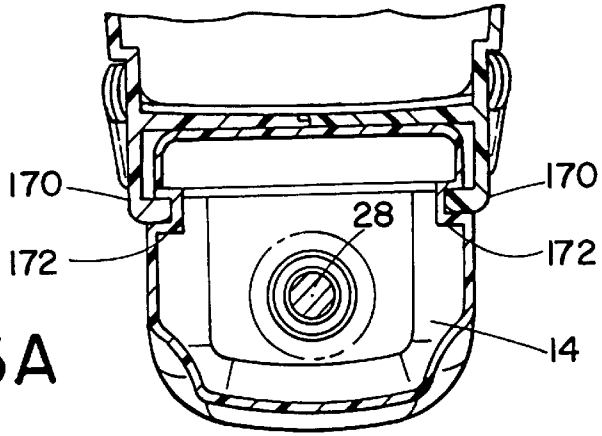
FIG. 3A is an enlarged cross section along line A—A of FIG. 3.

The bottle 14 is mounted on the housing 12 by a pair of fingers 170 of the housing which extend upward and are received in mating grooves 172 in the bottle by sliding the bottle downward onto the fingers, as shown in FIG. 3A. The bottle 14 is then locked in place by a pivoting latch 174 which snaps over a ridge 176 on the top of the bottle.

The clean water bottle 14 is designed to contain enough cleaning liquid to clean a floor of at least 250 square feet, preferably 250 to 300 square feet in area. In addition, the clean water bottle 14 preferably has a volume which is somewhat smaller than a volume of the dirty water tank 16. This allows the dirty water tank 16 to collect both a spilled liquid and the entire contents of the clean water bottle 14. For example, the clean water bottle 14 may have a capacity of about 16 oz, while the dirty water tank has a capacity of about 24 oz. Preferably, the volume of the tank 16 is about 20 to 60 percent greater than the volume of the bottle 14.

Although the clean water bottle 14 and the dirty water tank 16 have been referred to as a bottle and a tank, respectively, it should be understood that the terms bottle and tank refer generally to any type of container for liquid. These containers are preferably formed of a light weight, durable, and somewhat flexible material, such as plastic.

The first embodiment of the present invention includes a retractable sponge and a fixed pair of squeegees. However, it should be understood that a fixed sponge and movable squeegees may also be used.

Figures 6A, 6B:
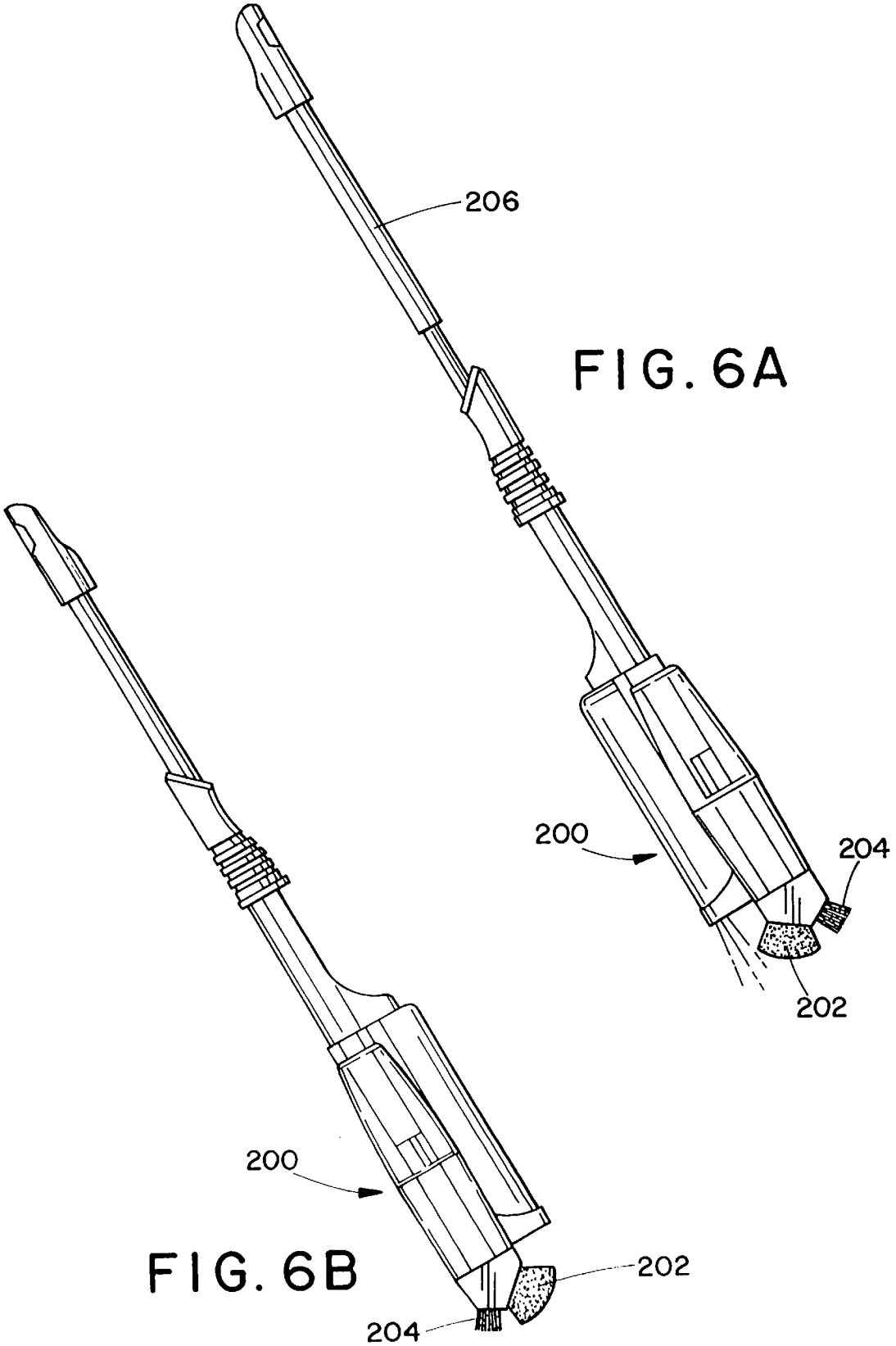
FIGS. 6A and 6B are opposite side views of a second embodiment of the invention.

FIGS. 6A and 6B illustrate an alternative embodiment of a cleaning device 200 in which a sponge 202 and squeegees 204 are provided in a fixed position on the bottom of the cleaning device. This embodiment is used to clean the floor in the position shown in FIG. 6A where the sponge 202 is in contact with the floor. Cleaning liquid may be dispensed onto the floor by pumping the handle 206 up and down before or during cleaning. When cleaning is complete, the device 200 is flipped over to the position illustrated in FIG. 6B so that the squeegees 204 are in contact with the floor and the floor may be dried in the manner described with respect to the first embodiment.

Figures 7A, 7B, 7C:
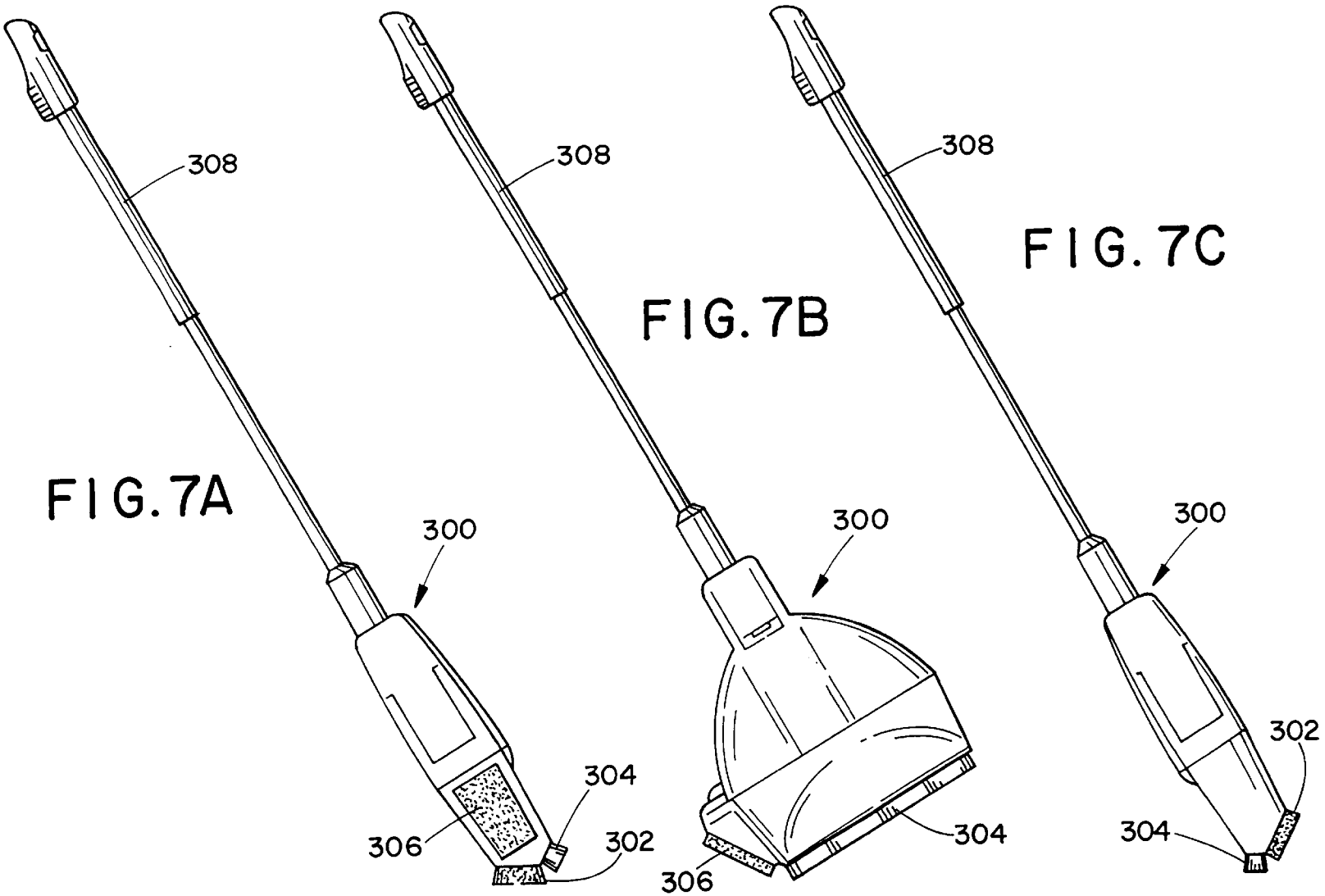
FIGS. 7A, 7B, and 7C are right, top, and left side views, respectively, of a third embodiment of the invention.

The embodiment of FIGS. 7A–7C is a cleaning device 300 also having a fixed sponge 302 and fixed squeegees 304 which is flipped between the orientations of FIGS. 7A and 7C for washing and drying operations. This embodiment also includes an additional scouring pad 306 which is positioned on one end of the device 300 and is used for scouring in the position illustrated in FIG. 7B. The scouring pad 306 may be removably attached, for example by Velcro. The cleaning device 300 also includes a telescoping handle 308.

Figures 8A, 8B:
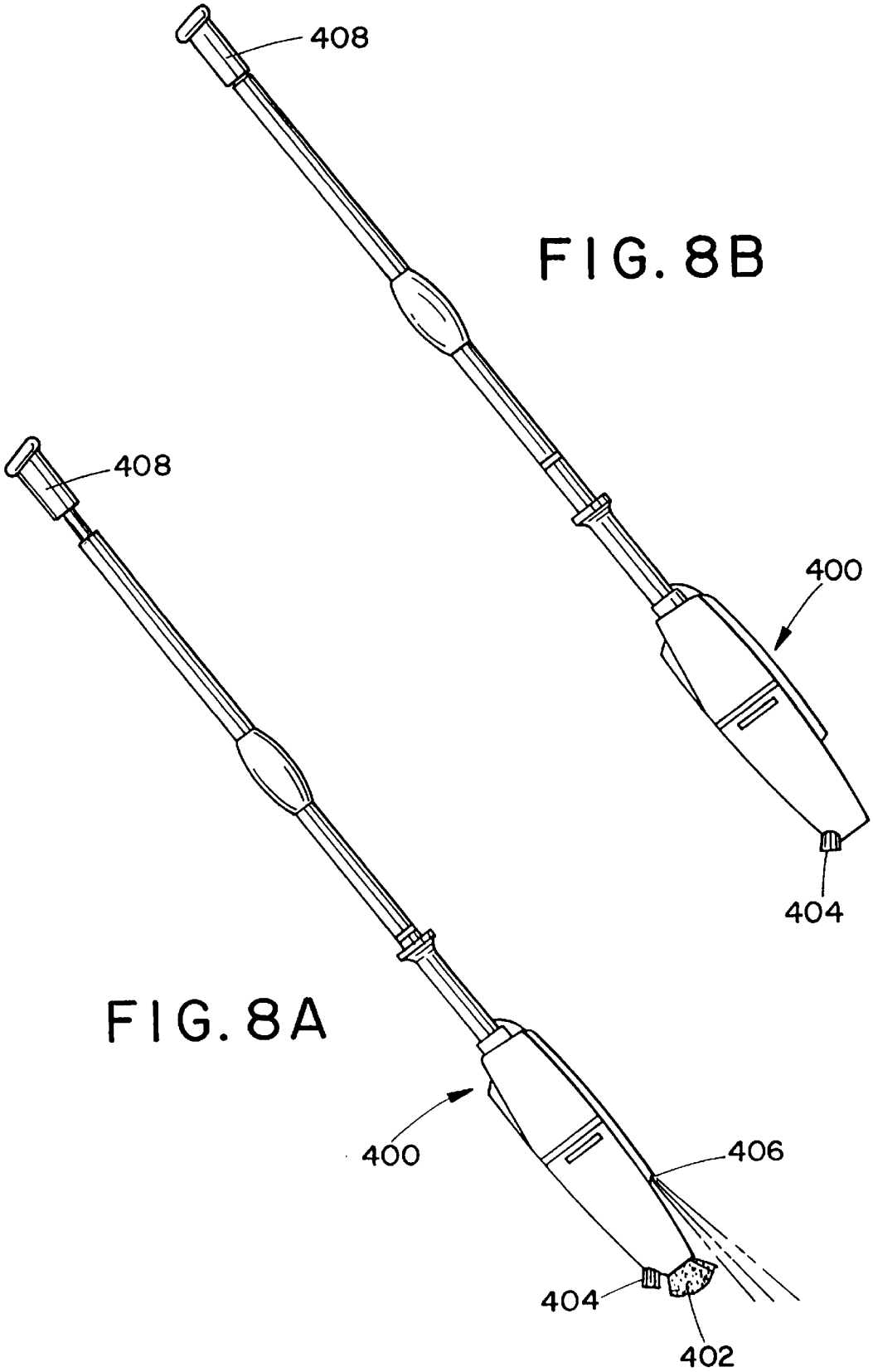
FIGS. 8A and 8B are side views of a fourth embodiment of the invention with the sponge in an extended and a retracted position.

A fourth embodiment of a cleaning device 400 is illustrated in FIGS. 8A and 8B. The cleaning device 400 includes a retractable sponge 402 and fixed squeegees 404. A cleaning liquid dispensing orifice 406 is located on a top of the device 400 and the pump handle 408 is used to pressurize the cleaning liquid so that it may be sprayed out of the dispensing orifice.

Figure 9:
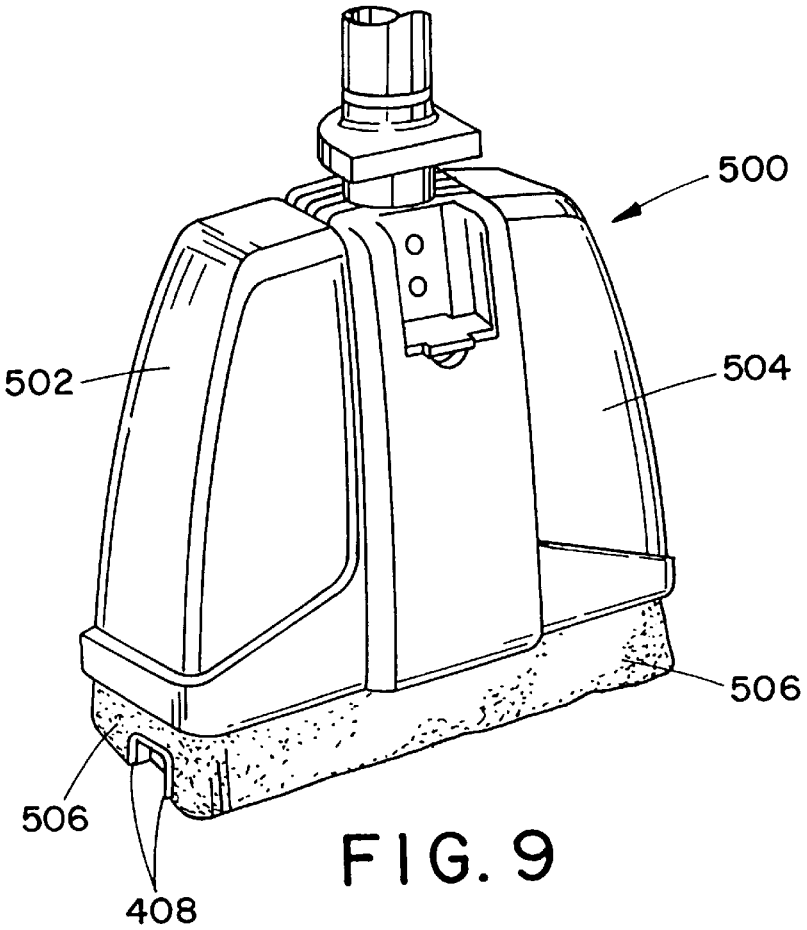
FIG. 9 is a perspective view of a fifth embodiment of the invention.

In the embodiment of the cleaning device 500 illustrated in FIG. 9, the clean water bottle 502 and the dirty water tank 504 are mounted side by side on the device. In addition, the sponge 506 is formed so that it surrounds the squeegees 508.

Figure 10:
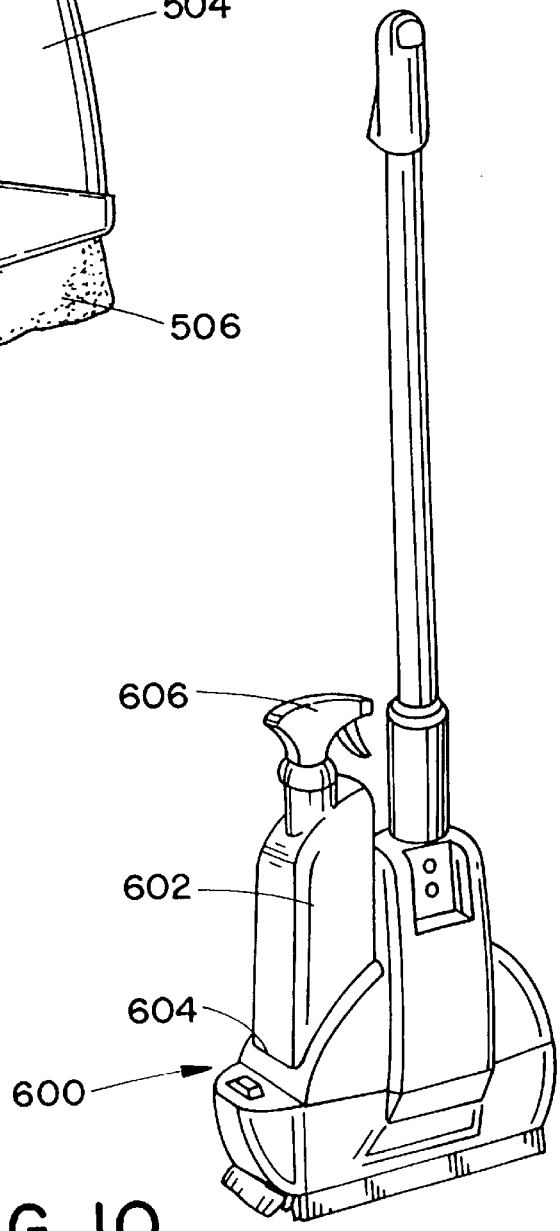
FIG. 10 is a perspective view of a sixth embodiment of the invention.

Finally, the cleaning device 600 of FIG. 10 has a removable dispensing bottle 602 received in a recess 604 in the body of the cleaning device. This dispensing bottle 602 has a spray nozzle 606 for spraying cleaning liquid onto the floor.

Advantages of each of the embodiments of the present invention include the fact that the device is a self-contained unit which includes clean water and there is no need to carry around heavy bucket of water. In addition, the problem of contamination of clean water is eliminated and the floor is left virtually dry. The device is also easily cleaned because once the dirty water tank is removed, any obstruction in the suction system can be easily seen and removed.

While the invention has been described in detail with reference to preferred embodiments thereof, it will be apparent to one skilled in the art that various changes can be made, and equivalents employed without departing from the spirit and scope of the invention.

What is claimed is:

1. A suction cleaning device comprising:

a cleaning device housing;

a handle extending from the housing;

a suction motor within the housing for removing a contaminated liquid from a surface to be cleaned;

a tank mounted on the housing for collecting the contaminated liquid which has been removed from the surface to be cleaned by operation of the suction motor; and a liquid dispensing bottle removably mounted on the housing for dispensing clean liquid onto the surface to be cleaned, the liquid dispensing bottle including a first opening sealed by a sealing member, a second opening sealed by a cap including an air vent, and an actuating member passing through the cap and connected to the sealing member for opening the first opening and the air vent to allow liquid to be dispensed by manipulation of the actuating member.

2. The cleaning device of claim 1, wherein the actuating member is a plunger which is spring biased toward a closed position of the sealing member.

3. The cleaning device of claim 1, wherein the actuating member includes an O-ring seal which seals the air vent when the sealing member is in a closed position.

4. The cleaning device of claim 1, wherein the liquid dispensing bottle further comprises a third opening for filling the bottle.

5. A suction cleaning device comprising:

a cleaning device housing;

a handle extending from the housing;

a suction motor within the housing for removing a contaminated liquid from a surface to be cleaned;

a tank mounted on the housing for collecting the contaminated liquid which has been removed from the surface by operation of the suction motor; and a liquid dispensing bottle removably mounted on the housing for dispensing clean liquid onto the surface to be cleaned, the liquid dispensing bottle including a first opening for dispensing liquid, a second opening sealed by a cap including an air vent, and a third opening for filling the bottle.

6. The cleaning device of claim 5, wherein the third opening for filling the bottle is formed on a side surface of the bottle which is adjacent the housing when the bottle is in a mounted position, and the third opening is closed by a measuring cap for measuring an amount of additive which is added to a liquid in the bottle.

7. A suction cleaning device comprising:

a cleaning device housing;

a handle extending from the housing;

an absorbent cleaning member mounted on the housing;

a clean liquid dispensing bottle mounted on the housing for dispensing clean liquid onto a surface to be cleaned;

a suction motor within the housing for removing a contaminated liquid from the surface to be cleaned; and a tank mounted on the housing for collecting the contaminated liquid which has been removed from the surface by operation of the suction motor, wherein a volume of the tank is greater than a volume of the bottle to prevent overfilling of the tank.

8. The cleaning device of claim 7, wherein the volume of the tank is at least 10 percent greater than the volume of the bottle.

* * * * *